US006232712B1

(12) United States Patent
Pyun et al.

(10) Patent No.: US 6,232,712 B1
(45) Date of Patent: May 15, 2001

(54) CATHODE RAY TUBE HAVING SPECIFIC THICKNESS RATIO

(75) Inventors: Do-Houn Pyun; Wan Kim; Chan-Yong Kim, all of Kyungki-Do (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/440,216

(22) Filed: Nov. 15, 1999

(30) Foreign Application Priority Data

Nov. 13, 1998 (KR) ..... 98-48556

(51) Int. Cl.[7] ..... H01J 31/00

(52) U.S. Cl. ..... 313/477 R; 313/408; 313/461; 313/478; 220/2.1 R; 220/2.1 A; 220/2.3 A; 220/2.3 R

(58) Field of Search ..... 313/477 R, 478, 313/408, 402, 407, 461; 220/2.1 R, 2.1 A, 2.3 A, 3.1 A, 2.3 R

(56) References Cited

U.S. PATENT DOCUMENTS

| | | | | |
|---|---|---|---|---|
| 4,535,907 | * | 8/1985 | Tokita et al. | 220/2.1 R |
| 4,537,321 | * | 8/1985 | Tokita | 220/2.1 R |
| 4,537,322 | * | 8/1985 | Okada et al. | 220/2.1 A |
| 4,985,658 | * | 1/1991 | Canevazzi | 313/477 R |
| 5,107,999 | * | 4/1992 | Canevazzi | 220/2.1 A |
| 5,151,627 | * | 9/1992 | Van Nes et al. | 313/477 R |
| 5,536,995 | * | 7/1996 | Sugawara et al. | 313/477 R |
| 5,663,610 | * | 9/1997 | Inoue et al. | 313/477 R |
| 5,814,933 | * | 9/1998 | Iwata et al. | 313/477 R |

FOREIGN PATENT DOCUMENTS

| | | |
|---|---|---|
| 06-36710 | 2/1994 | (JP) . |
| 06-44926 | 2/1994 | (JP) . |
| 6-44926 | 2/1994 | (JP) . |

* cited by examiner

*Primary Examiner*—Vip Patel
*Assistant Examiner*—Mariceli Santiago
(74) *Attorney, Agent, or Firm*—Christie, Parker & Hale, LLP

(57) ABSTRACT

A cathode ray tube includes a panel having a substantially flat outer surface and an inner curved surface with a phosphor screen. The panel has a substantially rectangular effective screen portion with two long sides parallel to each other, two short sides parallel to each other and four rounded edges interconnecting each long side and the neighboring short side. The effective screen portion is structured such that a first line V1 interconnecting centers of the long sides, a second line H1 interconnecting centers of the short sides and a third line D1 interconnecting centers of the rounded edges opposite to each other meet at a point. The effective screen portion has a first thickness Tv at the centers of the long sides, a second thickness Th at the centers of the short sides, a third thickness Td at the centers of the edges and a fourth thickness Tc at the meeting point of the first to third lines V1, H1 and D1. A shadow mask is disposed within the panel such that the shadow mask faces the inner curved surface of the panel. The shadow mask has a curvature corresponding to the inner curved surface of the panel. The ratio of the second thickness Th to the third thickness Td while subtracting the fourth thickness Tc from each thickness satisfies the following condition: $0.75 \leqq (Th-Tc)/(Td-Tc) \leqq 0.85$, and the ratio of the first thickness Tv to the third thickness Td while subtracting the fourth thickness Tc from each thickness satisfies the following condition: $0.75 \leqq (Tv-Tc)/(Td-Tc) \leqq 0.85$.

12 Claims, 4 Drawing Sheets

CATHODE RAY TUBE HAVING SPECIFIC THICKNESS RATIO

BACKGROUND OF THE INVENTION (a) Field of the Invention

The present invention relates to a cathode ray tube (CRT) and, more particularly, to a CRT which can minimize raster distortion of electron beams while maintaining structural strength of a shadow mask.

(b) Description of the Related Art

Generally, a faceplate panel for CRTs has a convex lens shape with inner and outer curved surfaces. The convex lens-shaped panel has advantageous in various aspects such as convenience in formation, stability in strength and adaptability for the shadow mask application.

However, to the eye of the viewer, it is desirable that the screen image should be displayed to be substantially flat. For this purpose, several attempts have been made to form the inner and outer surfaces of the faceplate panel with a flat shape while maintaining normal display characteristics of the CRT. It is found that when the flat panel is employed for the display screen use, there occur problems in convergence characteristic of electron beams and strength of a shadow mask. For instance, since the flat-shaped inner surface of the panel is naturally formed with a flat phosphor screen, it becomes difficult to deflect three electron beams of red R, green G and blue B on correct phosphors on the phosphor screen. Furthermore, since the shadow mask facing the flat-shaped inner surface of the panel should be also flat, the desired strength of the shadow mask cannot be achieved through the common shadow mask forming technique.

In addition, there is a problem with the flat-panel CRT that is derived from the standpoint of the viewer. When the viewer watches a monitor with the flat-shaped panel, he feels that the screen image is sunken at its center portion while protruded at its peripheral portion.

Therefore, it is preferable that the outer surface of the panel is flat whereas the inner surface of the panel is curved.

In such a faceplate panel, as the overall curvature radius of the inner curved surface of the panel becomes smaller, the panel is more easily produced and the shadow mask has a more stable structure capable of reducing a doming phenomenon. However, when the curvature radius falls short of a minimum effective value, the peripheral portion of the panel bears an undesirably large thickness and this results in poor production efficiency as well as high production cost. Furthermore, the transmission rate of the peripheral portion becomes poor due to its large thickness, causing brightness failure.

In order to overcome such problems, various techniques are proposed for the one-sided flat panel CRT application. For example, these techniques are disclosed in Japanese Patent Laid Open Publication Nos. 6-36710 and 6-44926. However, they do not specify technical details for preserving the structural strength of the shadow mask which should be re-designed pursuant to the curvature radii varying at different positions of the inner curved surface of the panel. Furthermore, they do not discriminate the desired thickness ratios of a diagonal portion of the panel to the peripheral portion for minimizing distortion of the screen image. Therefore, when the CRT panel is manufactured on the basis of the above-identified techniques, the aforementioned problems remain to be unsolved.

In the usual sized flat-panel CRTs of 21-inch, 25-inch and 29-inch, it turns out that the thickness ratios of the peripheral portion of the panel to the center portion are 3.13, 2.91 and 2.72, respectively. These ratios are so high that they result in poor production efficiency as well as brightness failure.

SUMMARY OF THE INVENTION

It is an object of the present invention to provide a CRT which can minimize raster distortion of electron beams while maintaining structural strength of a shadow mask.

This and other objects may be achieved by a CRT including a panel having a substantially flat outer surface and an inner curved surface with a phosphor screen. The panel has a substantially rectangular effective screen portion with two long sides parallel to each other, two short sides parallel to each other and four rounded edges interconnecting each long side and the neighboring short side. The effective screen portion is structured such that a first line V1 interconnecting centers of the long sides, a second line H1 interconnecting centers of the short sides and a third line D1 interconnecting centers of the rounded edges opposite to each other meet at a point. The effective screen portion has a first thickness Tv at the centers of the long sides, a second thickness Th at the centers of the short sides, a third thickness Td at the centers of the edges and a fourth thickness Tc at the meeting point of the first to third lines V1, H1 and D1. A shadow mask is disposed within the panel such that it faces the inner curved surface of the panel. The shadow mask has a curvature corresponding to the inner curved surface of the panel.

The ratio of the second thickness Th to the third thickness Td while subtracting the fourth thickness Tc from each thickness satisfies the following condition: $0.75 \leqq (Th-Tc)/(Td-Tc) \leqq 0.85$, and the ratio of the first thickness Tv to the third thickness Td while subtracting the fourth thickness Tc from each thickness satisfies the following condition: $0.75 \leqq (Tv-Tc)/(Td-Tc) \leqq 0.85$. The ratio of the third thickness Td to the fourth thickness Tc satisfies the following condition: $Td/Tc \leqq 2$.

The effective screen portion of the panel has a first curvature radius Rv on the first line V1, a second curvature radius Rh on the second line H1 and a third curvature radius Rd on the third line D1. The curvature radii Rv, Rh and Rd have an inter-relation of $Rv \leqq Rd \leqq Rh$.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
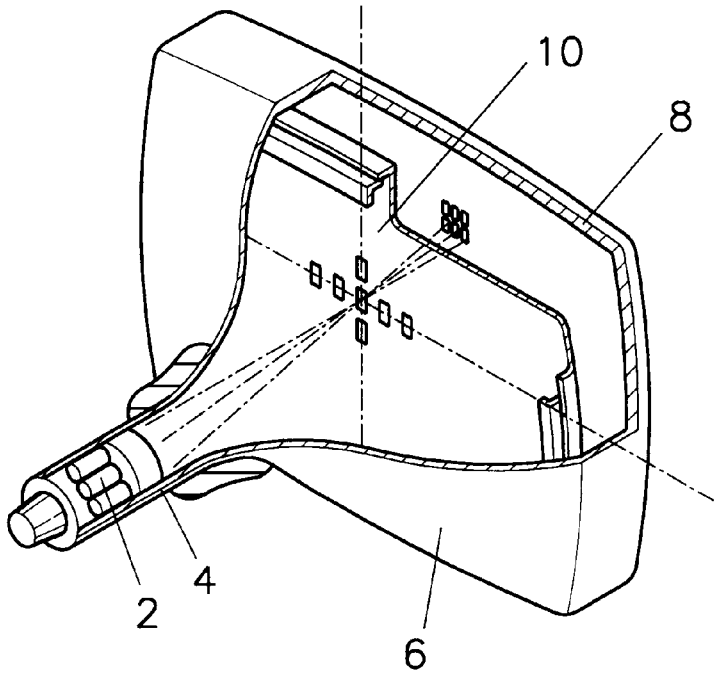
FIG. 1 is a partial sectional perspective view of a CRT with a panel according to a preferred embodiment of the present invention.

FIG. 1 is a partial sectional perspective view of a CRT according to a preferred embodiment of the present invention. The CRT includes a neck 4 having an electron gun 2 therein, a funnel 6 connected to the neck 4, and a panel 8 sealed to the funnel 6.

The panel 8 has an inner curved surface with a phosphor screen (not shown) and a substantially flat outer surface. A shadow mask 10 is disposed within the panel 8 and faces the inner curved surface of the panel 8. The shadow mask 10 is curved such that it can be adapted to the inner curved surface of the panel 8.

Figure 2:
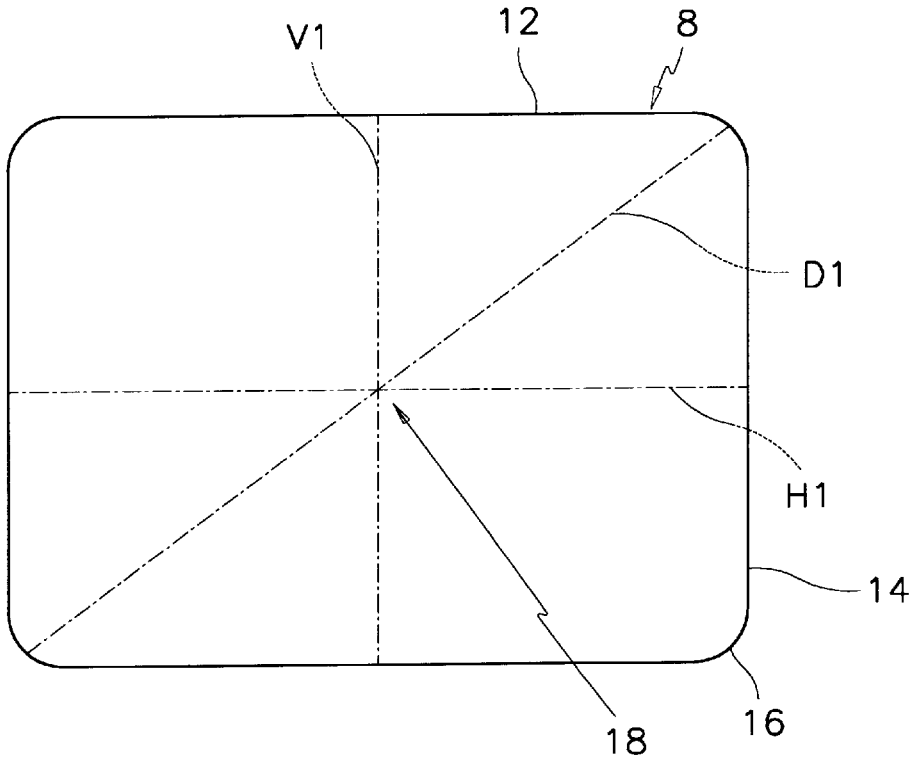
FIG. 2 is a front view of an effective screen portion of the panel shown in FIG. 1.

FIG. 2 illustrates a substantially rectangular effective screen portion of the panel 8. As shown in FIG. 2, the effective screen portion of the panel 8 has two long sides 12 parallel to each other, two short sides 14 parallel to each other, and four rounded edges 16 interconnecting each long side 12 and the neighboring short side 14. As shown in the drawing, a first virtual line V1 may be drawn such that it can interconnect centers of the long sides 12. A second virtual line H1 may be drawn such that it can interconnect centers of the short sides 14. A third virtual line D1 may be drawn such that it can interconnect centers of the edges 16 opposite to each other. The three virtual lines V1, H1 and D1 are indicated by long and short dashed lines in the drawing, and meet at a point 18.

The effective screen portion of the panel 8 has a first thickness Tv at centers of the long sides 12, a second thickness Th at centers of the short sides 14, a third thickness Td at centers of the edges 16, and a fourth thickness Tc at the meeting point 18 of the three virtual lines V1, H1 and D1.

The ratio of the second thickness Th to the third thickness Td while subtracting the fourth thickness Tc from each thickness is established to satisfy the following condition: $0.75 \leqq (Th-Tc)/(Td-Tc) \leqq 0.85$. Furthermore, the ratio of the first thickness Tv to the third thickness Td while subtracting the fourth thickness Tc from each thickness is established to satisfy the following condition: $0.75 \leqq (Tv-Tc)/(Td-Tc) \leqq 0.85$.

In the above conditions, when the minimum value is smaller than 0.75, raster distortion due to the deflection of the electron beams becomes increased. In contrast, when the maximum value is higher than 0.85, the inner surface of the panel 8 has an excessively small curvature, and the shadow mask 10 accordingly has an overall curvature so small that it cannot adequately maintain its strength.

Figure 3:
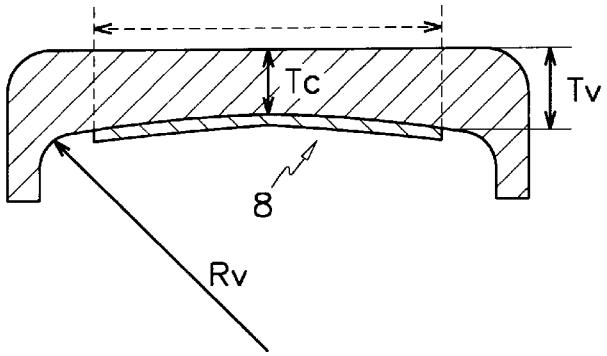
FIG. 3 is a sectional view of the panel shown in FIG. 1.
Figure 4:
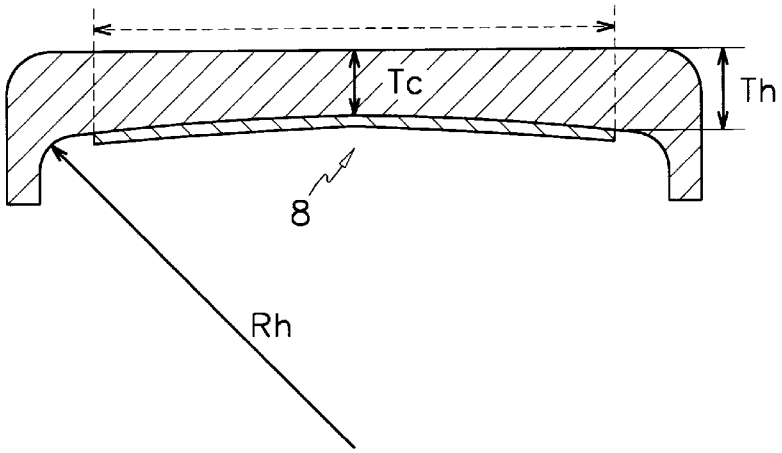
FIG. 4 is another sectional view of the panel shown in FIG. 1.
Figure 5:
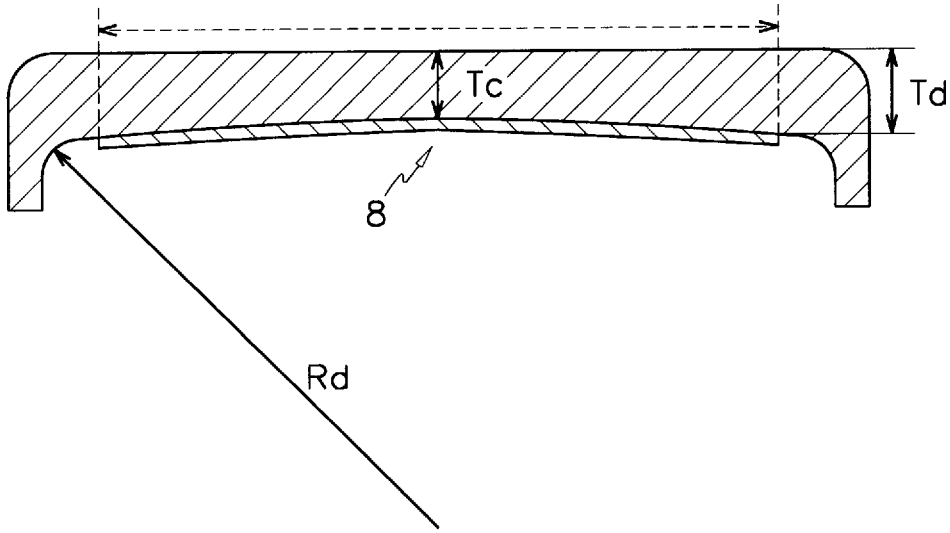
FIG. 5 is a still another sectional view of the panel shown in FIG. 1.

FIG. 3 is a sectional view of the panel 8 taken along the first virtual line V1 of FIG. 2, FIG. 4 is a sectional view of the panel 8 taken along the second virtual line H1 of FIG. 2, and FIG. 5 is a sectional view of the panel 8 taken along the third virtual line D1 of FIG. 2.

As shown in FIG. 3, the first thickness Tv is a value measured at the thickest portion of the effective screen portion on the first virtual line V1 of FIG. 2. As shown in FIG. 4, the second thickness Th is a value measured at the thickest portion of the effective screen portion on the second virtual line H1 of FIG. 2. As shown in FIG. 5, the third thickness Td is a value measured at the thickest portion of the effective screen portion on the third virtual line D1 of FIG. 2.

The values satisfying the above-identified thickness conditions in a 25-inch CRT panel and a 29-inch CRT panel are indicated in Table 1.

TABLE 1

| | 25-inch CRT panel | 29-inch CRT panel |
|---|---|---|
| Td-Tc (mm) | 25.4 | 26.3 |
| Th-Tc (mm) | 20.0 | 21.8 |
| Tv-Tc (mm) | 20.8 | 20.3 |
| Th-Tc/Td-Tc | 0.79 | 0.83 |
| Tv-Tc/Td-Tc | 0.82 | 0.77 |

Meanwhile, the ratio of the third thickness Td to the fourth thickness Tc is established to satisfy the condition of $Td/Tc \leqq 2$. In this condition, the screen image distortion can be effectively minimized.

The inner curved surface of the panel 8 has a first curvature radius Rv on the first virtual line V1, a second curvature radius Rh on the second virtual line H1, and a third curvature radius Rd on the third virtual line D1. These curvature radii Rh, Rv and Rd have an inter-relation of $Rv \leqq Rd \leqq Rh$.

The ratio of the second thickness Th to the fourth thickness Tc may be established to satisfy the following condition: $1.4 \leqq Th/Tc \leqq 1.6$. Furthermore, the ratio of the third thickness Td to the fourth thickness Tc may be established to satisfy the following condition: $1.7 \leqq Td/Tc \leqq 2.0$. In this case, the inner curved surface of the panel 8 may have a an unique curvature radius or varying curvature radii at different positions. Under these conditions, the panel 8 also exhibits good performance characteristics.

As described above, the inventive CRT has a panel with an effective screen portion that is structured to bear ideal thickness ratios among its respective portions as well as suitable curvature radii. As a result, raster distortion of the electron beams can be minimized and suitable structural strength of the corresponding shadow mask can be obtained.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A cathode ray tube comprising:

a panel having a substantially flat outer surface and an inner curved surface with a phosphor screen, the panel having a substantially rectangular effective screen portion with two long sides parallel to each other, two short sides parallel to each other and four rounded edges interconnecting each long side and the neighboring short side, the effective screen portion being structured such that a first line V1 interconnecting centers of the long sides, a second line H1 interconnecting centers of the short sides and a third line D1 interconnecting centers of the rounded edges opposite to each other meet at a point, the effective screen portion having a first thickness Tv at the centers of the long sides, a second thickness Th at the centers of the short sides, a third thickness Td at the centers of the edges and a fourth thickness Tc at the meeting point of the first to third lines V1, H1 and D1;

a shadow mask disposed within the panel such that the shadow mask faces the inner curved surface of the panel, the shadow mask having a curvature corresponding to the inner curved surface of the panel;

wherein the ratio of the second thickness Th to the third thickness Td while subtracting the fourth thickness Tc from each thickness satisfies the following condition: $0.75 \leqq (Th-Tc)/(Td-Tc) \leqq 0.85$, and the ratio of the first thickness Tv to the third thickness Td while subtracting the fourth thickness Tc from each thickness satisfies the following condition: $0.75 \leqq (Tv-Tc)/(Td-Tc) \leqq 0.85$.

2. The cathode ray tube of claim 1 wherein the ratio of the third thickness Td to the fourth thickness Td satisfies the following condition: $Td/Tc \leqq 2$.

3. The cathode ray tube of claim 1 wherein the effective screen portion of the panel has a first curvature radius Rv at the first line V1, a second curvature radius Rh at the second line H1 and a third curvature radius Rd at the third line D1, and the curvature radii Rv, Rh and Rd have an inter-relation of ad $Rv \leqq Rd \leqq Rh$.

4. A cathode ray tube comprising:

a panel having a substantially flat outer surface and an inner curved surface with a phosphor screen, the panel having a substantially rectangular effective screen portion with two long sides parallel to each other, two short sides parallel to each other and four rounded edges interconnecting each long side and the neighboring short side, the effective screen portion being structured such that a first line V1 interconnecting centers of the long sides, a second line H1 interconnecting centers of the short sides and a third line D1 interconnecting centers of the rounded edges opposite to each other meet at a point, the effective screen portion having a first thickness Tv at the centers of the long sides, a second thickness Th at the centers of the short sides, a third thickness Td at the centers of the edges and a fourth thickness Tc at the meeting point of the first to third lines V1, H1 and D1;

a shadow mask disposed within the panel such that the shadow mask faces the inner curved surface of the panel, the shadow mask having a curvature corresponding to the inner curved surface of the panel;

wherein the ratio of the second thickness Th to the fourth thickness Tc satisfies the following condition: $1.4 \leqq Th/Tc \leqq 1.6$, and the ratio of the third thickness Td to the fourth thickness Tc satisfies the following condition: $1.7 \leqq Td/Tc \leqq 2.0$.

5. The cathode ray tube of claim 4 wherein the effective screen portion of the panel has a first curvature radius Rv on the first line V1, a second curvature radius Rh on the second line H1 and a third curvature radius Rd on the third line D1, and the curvature radii Rv, Rh and Rd have an inter-relation of $Rv \leqq Rd \leqq Rh$.

6. The cathode ray tube of claim 4 wherein the inner curved surface of the panel has a unique curvature radius or varying curvature radii at different positions.

7. The cathode ray tube of claim 5 wherein the curvature radii Rv, Rh, and Rd are all either constant throughout the inner surface of the panel or varying at different positions.

8. A cathode ray tube comprising:

a panel having a substantially flat outer surface and an inner curved surface with a phosphor screen, the panel having a substantially rectangular effective screen portion with two first sides parallel to each other, two second sides parallel to each other, the second two sides being shorter than the first two sides, and four rounded edges each interconnecting one of the first sides with one of the second sides, the effective screen portion having a first thickness Tv at a center of one of the first sides, a second thickness Th at a center of one of the second sides, a third thickness Td at a center of one of the rounded edges and a fourth thickness Tc at a center of the effective screen portion; and a shadow mask disposed within the panel facing the inner curved surface of the panel, the shadow mask having a curvature corresponding to the inner curved surface of the panel;

wherein a thickness ratio of the effective screen portion satisfies the following condition: $0.75 \leqq (Th-Tc)/(Td-Tc) \leqq 0.85$, and $0.75 \leqq (Tv-Tc)/(Td-Tc) \leqq 0.85$.

9. The cathode ray tube of claim 8 wherein the thickness ratio of the effective screen portion further satisfies the following condition: $Td/Tc \leqq 2$.

10. The cathode ray tube of claim 8 wherein the effevtive screen portion of the panel has a curvature radius along a first line between the centers of the first sides, a curvature radius along a second line between the centers of the second sides, and a curvature radius along a diagonal line between the centers of two of the rounded corners, wherein the maximum curvature of radius along the first line and the minimum curvature of radius along the second line are equal to the curvature of radius along the diagonal line.

11. A cathoderay tube comprising:

a panel having a substantially flat outer surface and an inner curved surface with a phosphor screen, the panel having a substantially rectangular effective screen portion with two first sides parallel to each other, two second sides parallel to each other, the second two sides being shorter than the first two sides, and four rounded edges each interconnecting one of the first sides with one of the second sides, the effective screen portion having a first thickness Tv at a center of one of the first sides, a second thickness Th at a center of one of the second sides, a third thickness Td at a center of one of the edges and a fourth thickness Tc at a center of the effective screen portion; and a shadow mask diposed within the panel facing the inner curved surface of the panel, the shadow mask having a curvature corresponding to the inner curved surface of the panel;

wherein a thickness ratio of the effective screen portion satisfies the following conditions: $1.4 \leqq Th/Tc \leqq 1.6$, and $1.7 \leqq Td/Tc \leqq 2.0$.

12. The cathode ray tube of claim 11 wherein the effective screen portion of the panel has a curvature radius along a first line between the centers of the first sides, a curvature radius along a second line between the centers of the second sides, and a curvature radius along a diagonal line between the centers of two of the rounded corners, wherein the maxium curvature of radius along the first line and the minimum curvature of radius along the second line are equal to the curvature of radius along the diagonal line.

* * * * *